US005819627A

United States Patent [19]

Hayao

[11] Patent Number: 5,819,627

[45] Date of Patent: Oct. 13, 1998

[54] DEVICE FOR MAKING A HOLE IN AN INK CARTRIDGE

[75] Inventor: Sakae Hayao, Chatsworth, Calif.

[73] Assignee: Mitsubishi Pencil Corporation of America, Chatsworth, Calif.

[21] Appl. No.: 873,449

[22] Filed: Jun. 12, 1997

[51] Int. Cl.[6] ..... B26D 5/08

[52] U.S. Cl. ..... 83/631; 83/946; 83/451; 30/366

[58] Field of Search ..... 83/631, 30, 660, 83/946, 451; 30/358, 366, 381; 406/207; 62/293, 294

[56] References Cited

U.S. PATENT DOCUMENTS 2,060,888 11/1936 Newman ..... 81/3.29

3,092,291 6/1963 Franck ..... 222/83

3,438,656 4/1969 Fritch ..... 285/148.27

*Primary Examiner*—Ren Yan

*Assistant Examiner*—Dave A. Ghatt

*Attorney, Agent, or Firm*—Koda & Androlia

[57] ABSTRACT

A device for making a hole in an ink cartridge used in an ink jet printer comprising a main frame body to be mounted on the cartridge in a positionally immovable fashion by a combination of a cantilever type pressing member and a groove that respectively engage a recess and a flange of the cartridge. The main frame body has a screw with a pointed end so that when the screw is rotated the pointed end advances and penetrates into the cartridge, thus forming a hole in the cartridge so that ink can be refilled into the cartridge through the thus opened hole.

4 Claims, 3 Drawing Sheets

DEVICE FOR MAKING A HOLE IN AN INK CARTRIDGE

BACKGROUND OF THE INVENTION

1. Field of the Invention

The present invention relates to a device for making an ink refill hole in a used, empty ink cartridge used in an ink jet computer printer.

2. Prior Art

When the ink in an ink cartridge for an ink jet computer printer is entirely used up, it is currently customary at home and the office that, instead of installing a new ink cartridge filled with ink therein, the used cartridge is taken out of the printer and then the empty cartridge is refilled with ink, thus being reinstalled in the printer for further printing.

Various types of ink refilling devices have been proposed and marketed. One type is to fill ink into an ink cartridge through an aperture that is used by ink cartridge manufacturers for filling ink in the cartridge during the manufacturing process of ink cartridges. Since such an aperture provided on the top surface of the cartridge is closed by a sealing plug, the sealing plug is first removed, and an ink container is placed on the ink cartridge so that the ink is transferred from the ink container into the cartridge by way of gravity or, in some systems, using a syringe so that the ink is forced into the cartridge.

There is another type of ink cartridge called a non-refillable, disposable cartridge. This type of cartridge has no ink fill hole; therefore, when the user wishes to refill ink in this type of cartridge, it is necessary to make a hole so that ink can be transferred into the cartridge from an ink container through such hole. In order to make a hole for the transfer of ink, a drill, a hook screw and other hole-making tools are customarily used. However, the method of making a hole using drills, hook screws, etc. does not provide an accurate position of the ink transfer hole on the cartridge. If the ink transfer hole is not made at an appropriate position so that the ink transfer hole can communicate with the inside of the cartridge, the refilling of ink cannot be accomplished. In addition, when drills and hook screws are used, the inner circumferential surface of the hole made by such tools tends to be coarse, having burrs thereon. When the inner circumferential surface of the opened ink transfer hole is not smooth, such a coarse interior surface hinders a secure sealing of the ink transfer hole that is necessary to keep a reduced pressure inside the ink cartridge.

SUMMARY OF THE INVENTION

Accordingly, the primary object of the present invention is to solve the problems seen in the currently employed method for making an ink transfer hole in a used, empty non-refillable ink cartridge.

It is another object of the present invention to provide a device for making an ink transfer or ink refill hole in an ink cartridge easily and efficiently so that the opened ink refill hole has a smooth inner surface that can secure a complete sealing of the negative pressure inside the cartridge.

The objects of the present invention are accomplished by a unique structure for a device for making a hole in an ink cartridge, and it comprises:

- a main frame body comprising a top wall, a rear wall and two side walls so that the main frame body is open at its front and bottom;
- a guide groove formed on inner surfaces of two side walls and the rear wall of the main frame body so as to engage the flange of an ink cartridge;

- a pressing means formed on the inner surface of the rear wall of the main frame body, the pressing means having a projection at the free end thereof, and
- a screw means provided on the top wall of the main frame body so that a pointed end of the screw means penetrates the top end plate of the ink cartridge so as to make a hole therein.

The main frame body is set on an ink cartridge so that the guide groove thereof engages the flange of the ink cartridge, and the main frame body is slid until the projection of the pressing means of the main frame comes into an engagement with a recess formed on the top end plate of the cartridge. With this engagement of the projection of the pressing means and the engagement of the guide groove of the main frame body and the flange of the ink cartridge, the positioning of the main frame body on the cartridge is accomplished so that the main frame body is positionally secured on the ink cartridge; and then the screw means is turned so that the pointed end of the screw means advances and penetrates the top end plate of the ink cartridge, thus making a hole in the top end plate of the ink cartridge and allowing ink to be transferred from ink container into the ink cartridge.

DETAILED DESCRIPTION OF THE INVENTION

Figure 1:
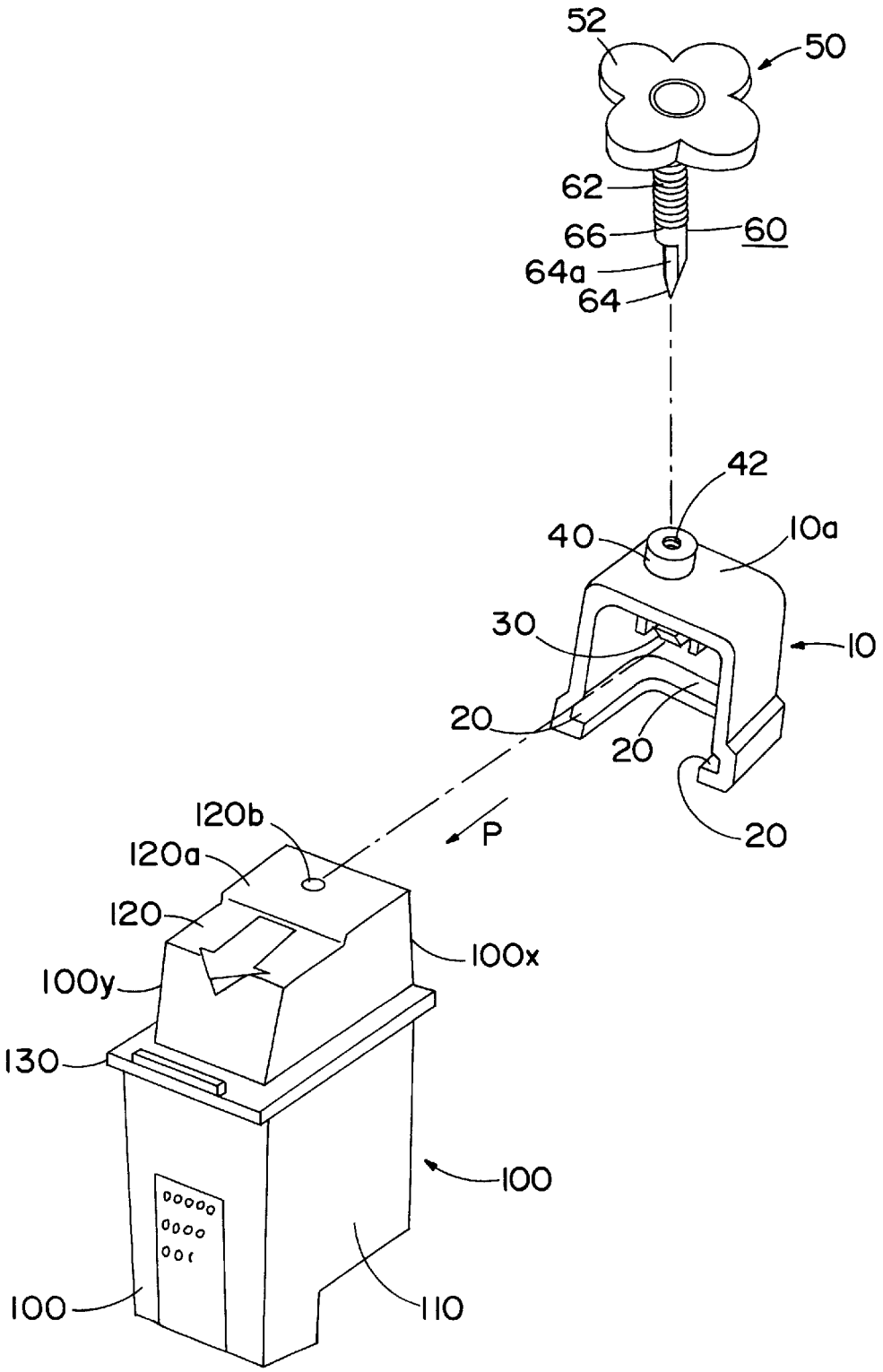
FIG. 1 is a perspective view of the ink hole making device for an ink cartridge according to the present invention.

The device of the present invention is comprised of a main frame body 10 and a screw means 50 fitted in the main frame body 10, so that, in use, the main frame body 10 having the screw means 50 can be set on an empty ink cartridge 100.

The ink cartridge 100 upon which the device of the present invention is used is a cartridge that includes a lower portion 110 and an upper portion 120 that are connected at the surrounding flange 130. The upper end plate 120*a* of the upper portion 120 has a recess 120*b* which is made during the process of molding the cartridge 100.

Figure 2:
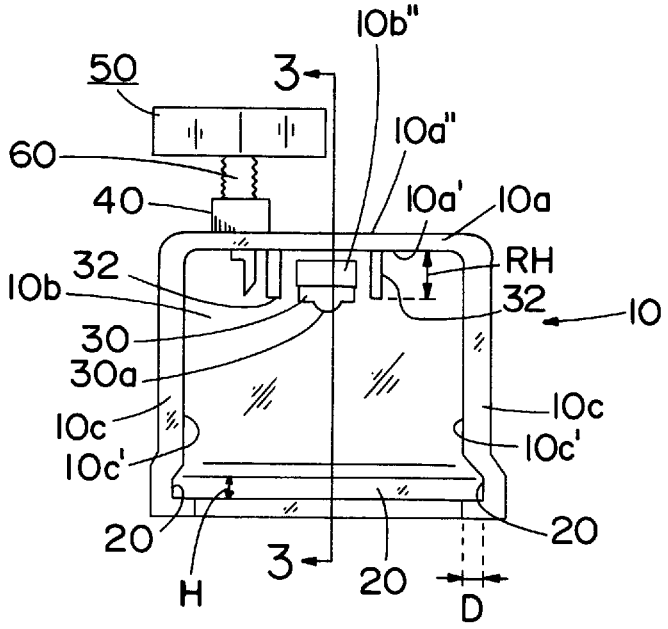
FIG. 2 is a front elevational view thereof.

The main frame body 10 is substantially a reversed U-shape synthetic resin frame as best seen in FIGS. 1 and 2 and comprises a top wall 10*a*, a back wall 10*b* and two side walls 10*c* which are formed into an integrated single unit. Thus, the main frame body 10 has an empty space therein but includes no front wall nor bottom wall, thus having the opened front area 10*f* (see FIG. 3) and opened bottom. An engagement groove 20 is formed on the inner surfaces 10*b*' of the back wall 10*b* and on the inner surface 10*c*' of two side walls 10*c*. The engagement groove 20 is formed continuously on the inner surfaces 10*b*' and 10*c*' and has a constant height H and a constant depth D, and the groove 20 is located near the lower edges of these walls 10*b* and 10*c*. The engagement groove 20 is shaped, with regard to the height H and depth D, so as to snugly receive and engage the flange 130 of the cartridge 100 when the main frame body 10 is set (as described later) on the cartridge 100 as shown in FIGS. 3 and 4.

Figure 3:
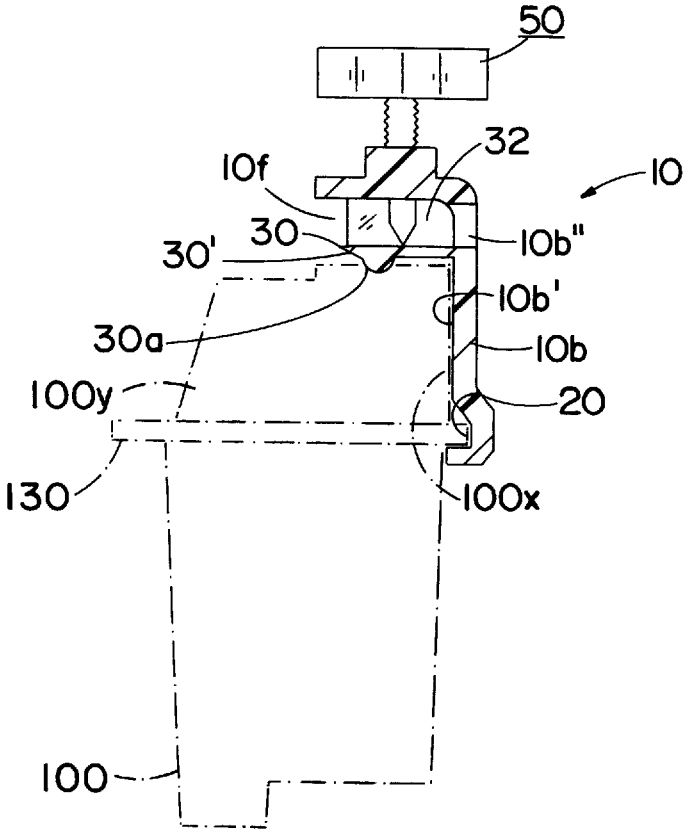
FIG. 3 is vertical cross sectional view thereof taken along the line 3—3 of FIG. 2.
Figure 4:
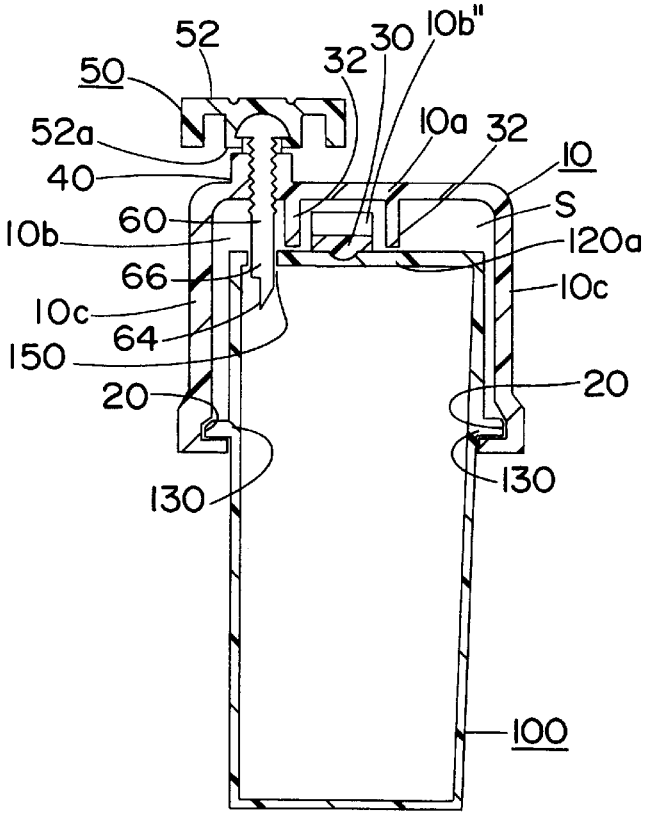
FIG. 4 shows a cross section showing the ink hole making device set on an ink cartridge.

In FIGS. 2 through 4, the reference numeral 10*b*" indicates a rectangular opening formed in the back wall 10*b* of the main frame body 10.

Furthermore, a pressing tongue 30 of a cantilever type is formed inside the main frame body 10 so as to extend from the inner surface 10*b*' of the back wall 10*b* of the main frame body 10 towards the opened front area 10*f* of the main frame body 10 and parallel with the top wall 10*a* of the main frame body 10. In addition, a pair of ribs 32 are formed on the inner surface 10*a*' of the top wall 10*a* of the main frame body 10 so that the ribs 32, as best shown in FIG. 2, spacedly sandwich (and protect) the pressing tongue 30 from both sides thereof. As seen from FIG. 2 (and FIG. 4), the lower ends of the ribs 32 are positioned substantially at the same horizontal level as the lower surface of the pressing tongue 30 The pressing tongue 30 is provided with a projection 30*a* on the under surface of the free end 30' thereof The projection 30*a* of the pressing tongue 30 has a size so as to snugly fit into the recess 120*b* formed in the top end plate 120*a* of the cartridge 100. The pair of ribs 32 has, as seen from FIG. 2, the height RH that can form a space S (see FIG. 4) between the top wall 10*a* of the main frame body 10 and the top end plate 120*a* of the ink cartridge 100 when the main frame body 10 is set on the cartridge 100 with the groove 20 of the main frame body 10 engaged with the flange 130 of the cartridge 100.

The main frame body 10 is further provided with a screw support 40 on the top wall 10*a*. The screw support 40 is a hollow cylinder having a central hole 42 and projecting outward from the outer surface 10*a*" of the top wall 10*a*. The central hole 42 opens on the inner surface 10*a*' of the top wall 10*a*, thus being a through hole opened through the top wall 10*a* of the main frame body 10. The central hole 42 of the screw support 40 is formed with an internal thread so as to guide the screw means 50 as described below.

The screw means 50 comprises a plastic turning knob 52 and a cylindrical metal shank 60 which is securely fixed to the turning knob 52. The metal shank 60 is provided with an external thread 62 on its upper portion, a gimlet end 64 at its lower end, and a smooth surfaced intermediate portion 66 between the external thread 62 and the gimlet end 64. The external thread 62 engages the internal thread formed in the central hole 42 of the screw support 40 of the main frame body 10 so that when the knob 52 is rotated in one direction after the shank 60 is inserted into the central hole 42 of the screw support 40, the screw means 50 advances in the direction of the gimlet end 64 (and retreats when the knob 52 is rotated in another direction). The gimlet end 64 is a pointed end and divided into half, as best seen in FIG. 1, in the axial direction so that it has a flat end portion 64*a* which facilitates the making of a hole in the ink cartridge 100.

In use, the ink cartridge 100 is held upright as shown in FIG. 1, and the main frame body 10 is placed on the upper portion 120 of the ink cartridge 100 as shown in FIGS. 3 and 4. In order to place the main frame body 10 on the cartridge 100, the main frame body 10 is first positioned near the back side 100*x* of the cartridge 100, and the groove 20 formed on the side walls 10*c* of the main frame body 10 is fitted on the flange 130 located on both sides of the cartridge 100; and then the main frame body 10 is pushed towards the front side 100*y* of the cartridge 100 or in the direction of allow P shown in FIG. 1 until the groove 20 formed on the back wall 10*b* of the main frame body 10 engages the flange 130 located on the back side 100*x* of the cartridge 100.

When the main frame body 10 is thus slid all the way until the groove 20 of the back wall 10*b* engages the flange 130 of the back side 100*x* of the cartridge 100, the projection 30*a* of the pressing tongue 30, which is elastically bent upwardly because of the projection 30*a* sliding on the upper surface of the top end wall 120*a* of the cartridge 100, comes into an engagement with the recess 120*b* of the cartridge 100 as shown in FIG. 3. In addition, lower end surfaces of the ribs 32 are positioned slightly above the upper surface of the cartridge 100. As a result, the free end 30' of the pressing tongue 30 is elastically pressed against the (bottom of the) recess 120*b*. With this engagement between the projection 30*a* of the pressing tongue 30 of the main frame body 10 and the recess 120*b* of the ink cartridge 100, and with the engagement between the groove 20 of the main frame body 10 and the flange 130 of the ink cartridge 100, the main frame body 10 is securely positioned on the ink cartridge 10 and its vertical and lateral movements are restrained.

Then, the screw means 50 is turned via the turning knob 52. When the turning knob 52 is turned in one direction, the shank 60 of the screw means 50 advances towards the top end plate 120*a* of the cartridge 100 and the pointed gimlet end 64 penetrates into the top end plate 120*a* of the cartridge 100, thus, as shown in FIG. 4, making a hole 150 in the top end plate 120*a* of the cartridge 100. When the bottom 52*a* of the turning knob 52 comes into contact with the top end surface of the screw support 40 as a result of the advance of the shank 60, the shank 60 of the screw means 50 is restrained so as not to advance any further, thus the operator is able to know that the hole has been made through the thickness of the top end plate 120*a* of the cartridge 100. Then, the screw means 50 is turned in another direction, so that the shank 60 retreats out of the top end plate 120*a*, and the pointed gimlet end 64 is moved out of the opened hole 150. Then, the main frame body 10 is pulled in the direction opposite from arrow P by overcoming the elastically pressing force of the projection 30*a* of the pressing tongue 30 so as to take the projection 30*a* out of the recess 120*b* of the cartridge. The main frame body 10 can thus be removed from the ink cartridge 100.

In the above hole-making operation, when the gimlet end 64 penetrates the top end plate 120*a* of the cartridge 100, the intermediate portion 66 having a smoothed outer surface smooths out of the inner surface of the hole 150 formed by the gimlet end 64. Accordingly, the hole 150 made in the top end plate 120*a* of the cartridge 100 is smooth with no burrs on its inner surface.

In addition, as seen from the above description, the length of the gimlet end 64 and the length of the smooth surfaced intermediated portion 66 of the screw means 50 are respectively larger than the thickness of the top end plate 120, and the entire length of the shank 60 is long enough so that the gimlet end 64 and the intermediate portion 66 can penetrate through the thickness of the top end plate 120*a* but not come into contact with internal composite elements of the cartridge 100. In addition, the projection 30*a* is formed on the pressing tongue 30 at an appropriate distance from the rear wall 10*b* of the main body 10 so that the pressing tongue 30 accurately fit in the recess 120*b* of the cartridge 100.

Figure 5:
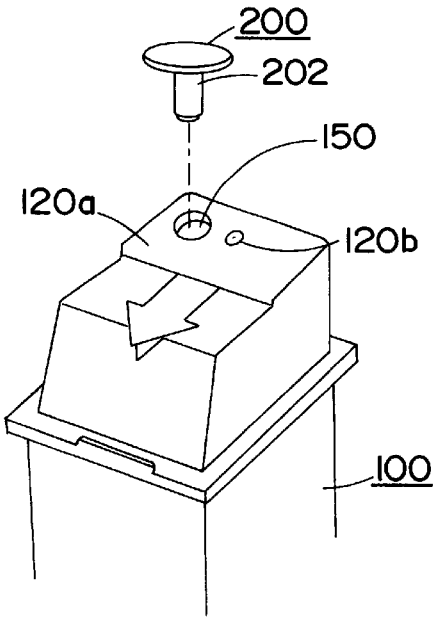
FIG. 5 shows an ink cartridge with an ink hole made by the device of the present invention shown in FIG. 1.

When the hole 150 is made as described above, ink is transferred from an ink container (not shown) into the cartridge 100 through the hole 150 by appropriate ink refilling devices such as the one disclosed in the U.S. Pat. No. 5,595,223; and after the cartridge 100 is filled with ink, the hole 150 is closed, as shown in FIG. 5, by a closing plug 200 that has a sealing leg 202 which fits tightly in the hole 150.

As seen from the above, according to the present invention, the main frame body for forming a hole in an ink cartridge is securely positioned on the ink cartridge so that a screw means penetrates the ink cartridge and makes a hole therein so that ink can be transferred into the cartridge so as to refill it.. Thus, an ink transfer or refill hole can be easily formed in the cartridge and such an ink hole has a smooth inner surface that assures a tight sealing of the ink refill hole so as to secure a reduced inner pressure of the ink cartridge.

I claim:

1. A device for making a hole in an ink cartridge comprising:

a main frame body comprising a top wall, a back wall and two side walls thus having an empty space therein;

a groove formed on an inner surface of each of said back wall and said side walls;

a pressing means extending from an inner surface of said back wall so as to be substantially parallel to said top wall, said pressing means being formed with a projection at an end thereof;

a hole making means having a pointed end and rotatably provided in said top wall of said main frame body.

2. A device according to claim 1, further comprising a pair of ribs provided in said main frame body so as to spacedly sandwich said pressing mens.

3. A device according to claim 2, wherein said hole making means comprises:

a turning knob;

a cylindrical shank member securely fixed to said turning knob, said shank member being provided with an external thread portion and a smooth surfaced portion which is between said external thread portion and said pointed end.

4. A device according to claim 1, wherein said hole making means comprises:

a turning knob;

a cylindrical shank member securely fixed to said turning knob, said shank member being provided with an external thread portion and a smooth surfaced portion which is between said external thread portion and said pointed end.

* * * * *